United States Patent [19]

Baitz et al.

[11] Patent Number: 5,039,233

[45] Date of Patent: Aug. 13, 1991

[54] PRINTING DEVICE

[75] Inventors: Guenter Baitz; Wolfgang Malke, both of Berlin, Fed. Rep. of Germany

[73] Assignee: Siemens Nixdorf Informationssysteme AG, Paderborn, Fed. Rep. of Germany

[21] Appl. No.: 435,804

[22] Filed: Nov. 13, 1989

[30] Foreign Application Priority Data

Nov. 14, 1988 [DE] Fed. Rep. of Germany ... 8814238[U]

[51] Int. Cl.[5] ..... B41J 11/20

[52] U.S. Cl. ..... 400/55; 400/59

[58] Field of Search ..... 400/124, 139, 160, 55, 400/59, 23, 31, 41, 29

[56] References Cited

U.S. PATENT DOCUMENTS

| | | | |
|---|---|---|---|
| 4,202,637 | 5/1980 | Tummolo | 400/31 |
| 4,514,100 | 4/1985 | Laspesa | 400/55 |
| 4,738,552 | 4/1988 | Kikuchi et al. | 400/59 |
| 4,775,869 | 10/1988 | Minowa | 400/59 |
| 4,893,950 | 1/1990 | Ragen et al. | 400/55 |
| 4,906,115 | 3/1990 | Bischof | 400/55 |

FOREIGN PATENT DOCUMENTS

| | | | |
|---|---|---|---|
| 2824621 | 12/1979 | Fed. Rep. of Germany | 400/59 |
| 3214633 | 10/1983 | Fed. Rep. of Germany | 400/55 |
| 3521093 | 12/1985 | Fed. Rep. of Germany | 400/59 |

*Primary Examiner*—Eugene H. Eickholt

*Attorney, Agent, or Firm*—Varnum, Riddering, Schmidt & Howlett

[57] ABSTRACT

A printing device is disclosed, consisting of a chassis (10), an abutment (40), and relative to the abutment in the direction of lines, an adjustable printing head (36) and a chassis fixed stop (16) for fixing the printing position of a print carrier (18), inserted between the printing head (36) and the abutment (40). The stop (16) is assigned a holding device (20) for holding the print carrier in its printing position, whereby the beam-shaped abutment (40) and the printing head (36) are carried on a pivoting frame (42), which on chassis (10) parallel to abutment (40) and a distance to an axis (44) is carried in a pivoted mode and by way of a pivoting drive (62–72) is adjustable.

24 Claims, 3 Drawing Sheets

PRINTING DEVICE

TECHNICAL FIELD

The invention concerns a printing device comprising a chassis, an abutment, a printing head adjustable relative to the abutment in the direction of lines and a chassis fixed stop, fixing the printing position of an insertable print carrier between the printing head and the abutment.

BACKGROUND ART

Such printing devices as described above are known, for an example, from DE-OS 35 14 062. The known printing device is positioned in a cash dispensing unit for the printing of check blanks and such, where either one line is printed onto the print carrier or the print carrier is moved relative to the printing head to be able to print several lines.

In practice, the problem occurs that the print carrier can not be moved freely. This is the case, for an example, with labels, which already are attached to merchandise and have to be printed later. At the same time, the problem arises when a large number of print carriers have to be imprinted in the shortest possible time and that this imprint as a rule has to consist of several lines.

SUMMARY OF THE INVENTION

The invention has the object to employ a printing device of the above mentioned type which makes possible the imprinting of a fixed print carrier in a short time span.

This task is solved by the invention in that a holding device is associated with the stop for the holding of the print carrier in the printing position and that the beam shaped abutment and the printing head are arranged on a pivoting frame, which is arranged in a pivoting mode around a pivoting axis parallel to the abutment and is adjustable by way of a pivoting drive.

By holding the print carrier during printing and the arrangement of the abutment and the printing head on the pivoting frame, it is possible with the appropriate control of the pivoting drive to accomplish a multi-line imprint on the stationary print carrier, whereby the spacing of the lines can be chosen. This makes it possible to imprint with high precision into defined fields of the print carrier. The adjustment of the pivoting frame can be accomplished very quickly, so the time needed for the line feed is very short. This is especially valid when the pivoting frame is rotatable around a horizontal axis and during the printing cycle will be adjusted downward line by line, because then the control drive will be assisted by gravity acting on the pivoting frame.

The holding device preferably should have a clamping drive with at least one clamping element, which is adjustable by a clamping drive relative to a stop strip supporting the print carrier, whereby the clamping drive preferably is an electromagnet.

The printing head can be mounted by known methods to a carrier which is mounted on the pivoting frame such that it is movable in parallel to the abutment. In order to keep the adjustment forces for the pivoting frame as low as possible, it is preferable if the drive motor for the carrier is close to the pivoting axis or even is located on the pivoting frame on the side of the pivoting axis facing away from the abutment. In this case, a counterweight by the drive motor for the printing head has been created and with that the pivoting frame can be balanced.

A very dependable and precise adjustment of the pivoting frame can be accomplished, when on the pivoting frame near the abutment, a curved gear segment is arranged, which engages with a driven gear mounted on the chassis and driven by a stepping motor.

Instead of a linear adjustment of the printing head carrier on suitable guides, it is suggested by the invention that the printing head carrier is a rocker arm, which is mounted in a pivoting mode around an axis perpendicular to the pivoting axis and as a whole parallel to the printing surface, the abutment forming a circular arch around the rocker arm axis. Instead of the relatively expensive slide and roll guides for the printing head carrier, only a simple pivot bearing for the rocker arm is needed.

BRIEF DESCRIPTION OF THE DRAWINGS

Further benefits and features of the invention will be demonstrated by the following description, which in connection with the enclosed drawings will explain the invention by use of examples. With reference to the drawings.

DETAILED DESCRIPTION

Figure 1:
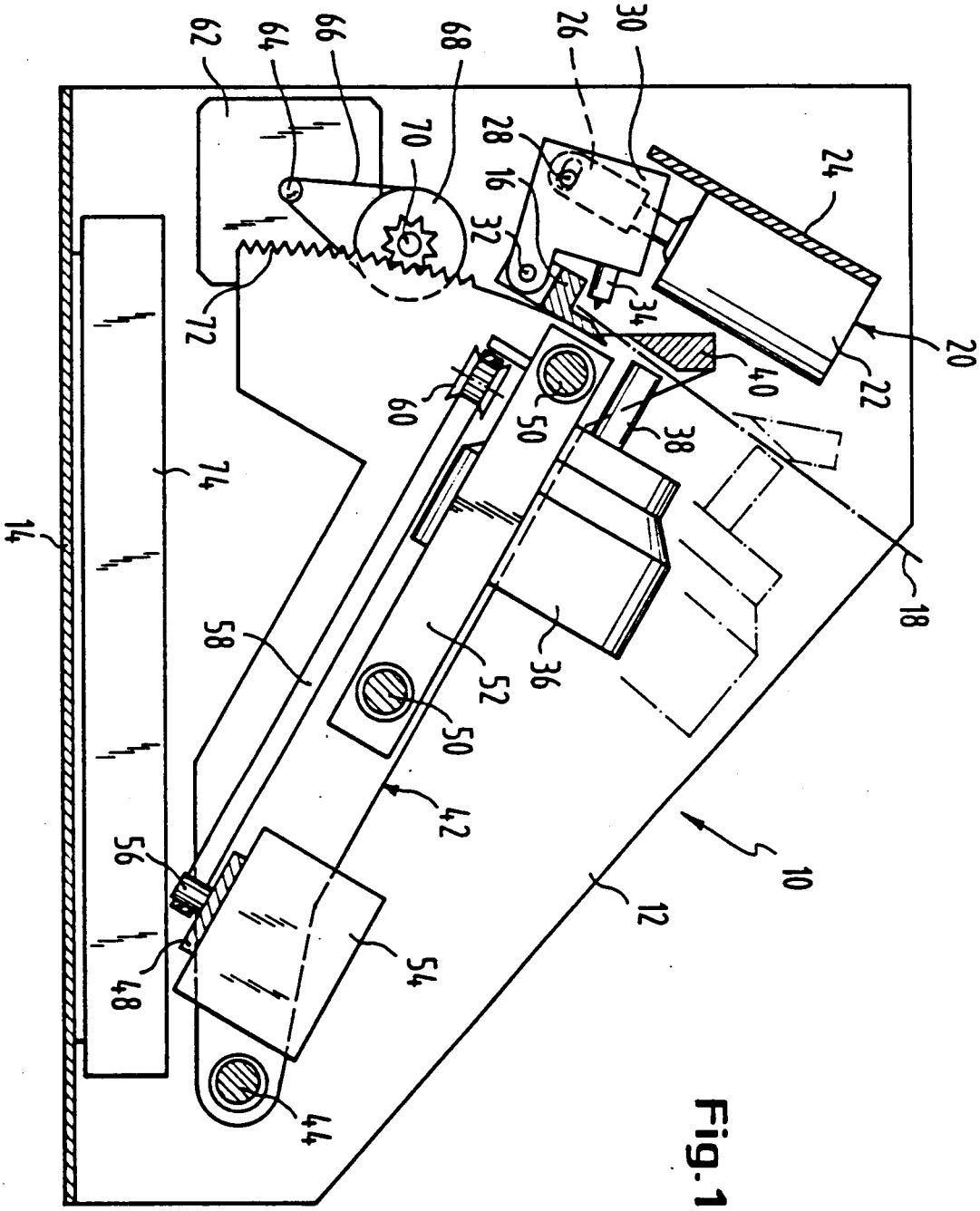
FIG. 1 is a partially cut schematic side view of a printing device in accordance with the invention.
Figure 2:
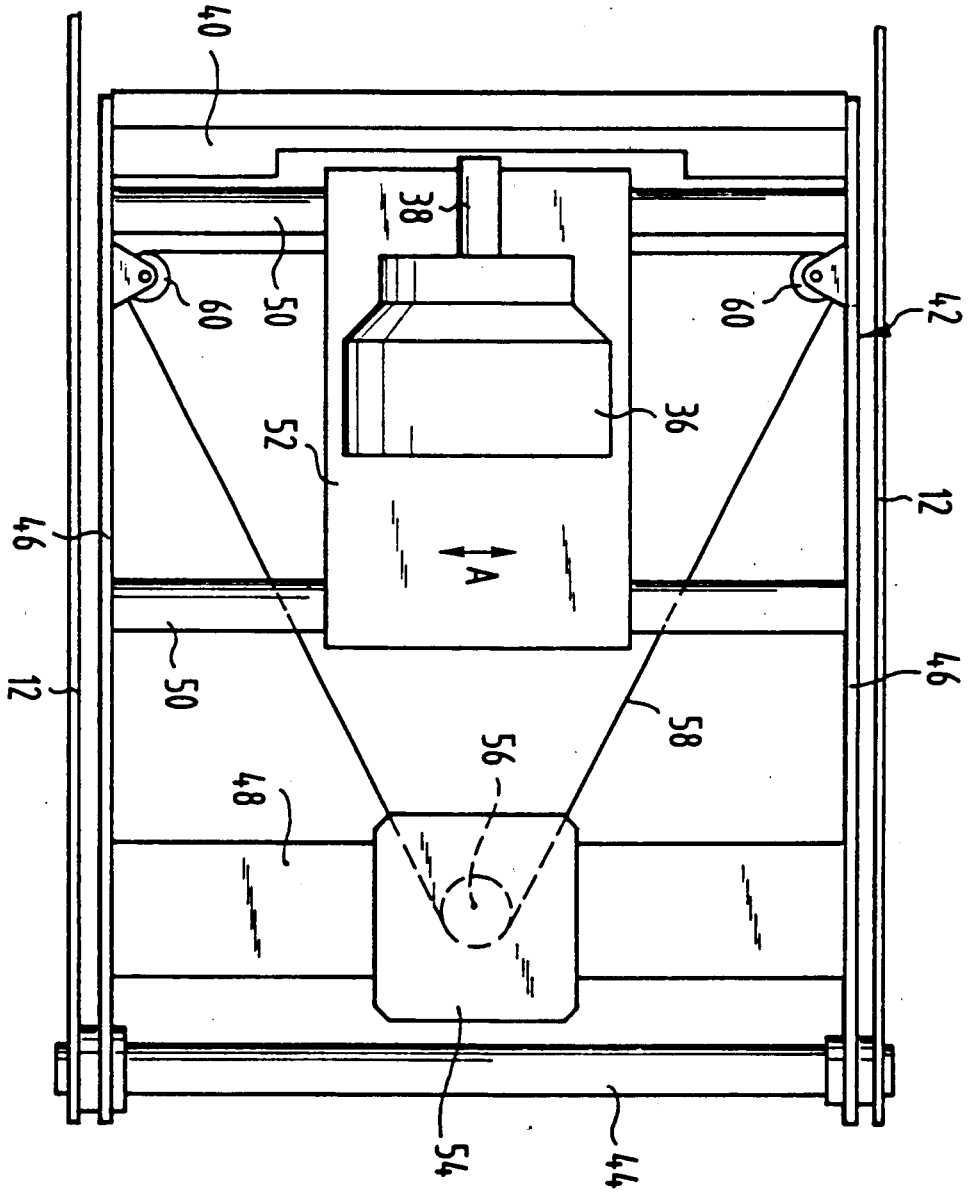
FIG. 2 is a schematic top view of the pivoting frame only.

The printing devices illustrated in FIGS. 1 and 2 consist of a chassis 10, of which only the side walls 12 and the bottom plate 14 are implied. Between the side walls 12 and perpendicular to these is a stop strip 16 having an L-shape profile and serving as a support and positioning stop for the printing carrier 18. This stop strip 16 is associated with a clamping device, designated in general with numerical reference 20. This comprises an electromagnet 22, which is mounted to a strip 24, extending between the side walls 12 of chassis 10. The armature 26 of the electromagnet 22 engages over a pin-elongated-slot connection 28 to a clamping piece 30, which is supported on the stop strip 16 rotatable around shaft 32 and is equipped with a clamping pin 34, with which the print carrier 18 can be held in position at the stop strip 16, when the clamping piece 30 in the position shown in FIG. 1 is swiveled in a clockwise direction in its clamping position.

For the imprinting of the print carrier 18, a needle printing head 36 with mouthpiece 38 is employed. During the printing cycle, the print carrier is supported by a beam shaped abutment 40. The abutment 40 as well as the printing head 36 are arranged on a pivoting frame generally designated by numerical reference 42, which is supported in a pivoting mode on a shaft 44. The shaft 44 extends between the side walls 12 of the chassis 10, so that the printing head 36 and abutment 40 can be rotated between the positions as shown in FIG. 1 by the continuous lines and dotted lines, respectively. The pivoting frame 42 consist of two side panels 46 (FIG. 2) which are connected by a traverse 48, the abutment 40 as well as by two guide rods 50.

A slide 52 carrying the printing head 36 is guided on the guide rods 50 in the direction of the double arrow A in FIG. 2, to enable the printing of one line onto the print carrier 18. The slide 52 is driven by an electric motor 54 disposed on the traverse 48, whose shaft 56 drives a belt 58, which is led over rolls 60 on the side panels and is fastened to slide 52.

The pivoting drive for the pivoting frame 42 comprises a stepping motor 62 (mounted on the chassis by suitable means but not shown) whose output shaft 64 via belt 66 and a pulley 68 drives a gear shaft 70, which engages with gear segments 72, curved around the pivoting shaft 44 on the sides 46 of the pivoting frame 42. With that, the printing head 36 and the abutment 40 can be adjusted to imprint several lines on the print carrier 18.

Underneath the pivoting frame 42 is located an electronic control device 74, which includes the control for the drives 62 and 54, the clamping device 20 and the printing head 36.

Figure 3:
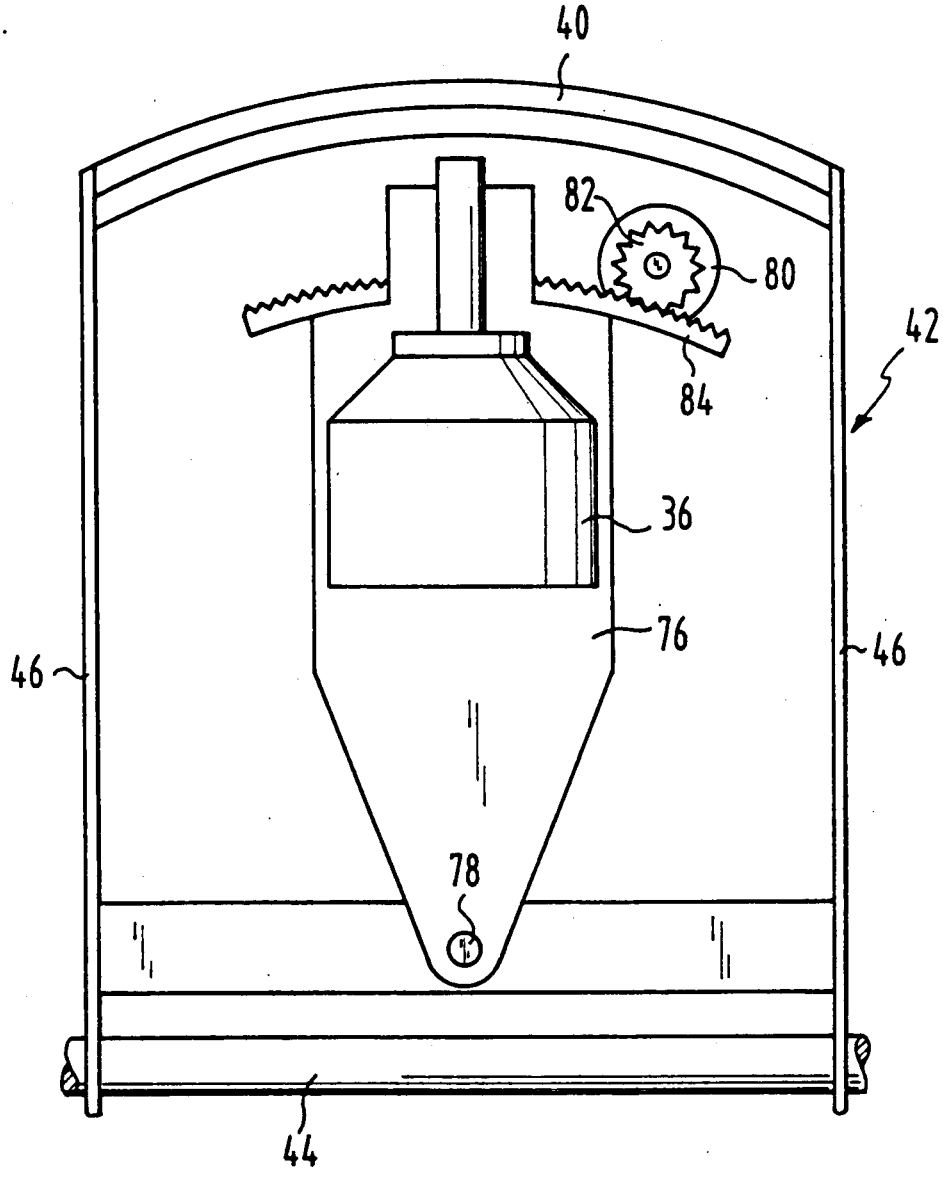
FIG. 3 is a schematic top view of the pivoting frame according to a second embodiment of the invention for the printing device.

The second embodiment shown in FIG. 3 distinguishes itself from the embodiment of FIG. 1 and FIG. 2 by a different adjustment of the printing head 36 in the direction of the lines. The printing head 36 is carried on a rocker arm 76, mounted on an axis 78 which is perpendicular to pivoting shaft 44 and almost parallel to the printing surface. The front end of the mouth piece 38 of the printing head 36 moves along a circular path by pivoting of the rocker arm 76. In the same way, the beam shaped abutment 40 is bent in a circular arch around rocker arm axis 78. For an example, the adjustment of the rocker arm can be accomplished by an electric motor 80, whose output pinion 82 engages with the circular arch-like rack 84 fastened to the rocker arm 76. With this arrangement, because of the large lever arm in regards to rocker arm axis 78, only a small amount of adjustment power is needed for the adjusting of rocker arm 76.

The embodiments of the invention in which an exclusive property or privilege is claimed, are defined as follows:

1. Printing device comprising a chassis (10), a beam-shaped abutment (40), and relative to the abutment in the direction of print lines, an adjustable printing head (36) and a fixed stop (16) on the chassis for fixing the printing position of a print carrier (18), inserted between the printing head (36) and the abutment (40), characterized by that the stop (16) is assigned a holding device (20) for the holding of the print carrier (18) in its printing position and that the beam-shaped abutment (40) and the printing head (36) are mounted on a pivoting frame (42), which on the chassis on a pivoting axis (44) is carried in a pivoting mode and is adjustable by way of a pivoting drive (62 to 72; 76 to 88) in operative association with the chassis (10), the pivoting axis (44) being parallel to the abutment (40).

2. Printing device in accordance with claim 1 characterized by that the holding device includes a clamping device with at least one clamping element (30) which, by way of a clamping drive (22, 26) in operative association with the clamping device, is adjustable relative to the fixed stop (16) supporting the print carrier (18).

3. Printing device in accordance with claim 2 characterized by that the printing head (36) is carried on a carrier (52) which in turn is adjustably guided on the pivoting frame (42) for a movement parallel to the abutment (40), and further comprising an electric motor (54) for driving the carrier (52), which motor (54) is located near the pivoting axis (44) on the pivoting frame (42).

4. Printing device in accordance with claim 2 characterized by that on the pivoting frame (42) near the abutment (40), a gear segment (72) curved around the pivoting axis (44) is located, which engages with a gear shaft (70) driven by a stepping motor (62) and carried on the chassis (10).

5. Printing device in accordance with claim 2 characterized by that the printing device is adapted for use with a printing surface, and the printing head is carried on a rocker arm (76) which is mounted on the pivoting frame (42) in a pivoting mode around a second axis (78) which is perpendicular to the pivoting axis (44) and as a whole is parallel to the printing surface, and that the abutment (40) is bent in circular arch form around the second axis 78.

6. Printing device in accordance with claim 1 characterized by that the printing head is carried on a carrier which in turn is adjustably guided on the pivoting frame for a movement parallel to the abutment, and further comprising an electric motor for driving the carrier, which motor is located near the pivoting axis on the pivoting frame.

7. Printing device in accordance with claim 6 characterized by that on the pivoting frame near the abutment, a gear segment curved around the pivoting axis is located, which engages with a gear shaft driven by a stepping motor and carried on the chassis.

8. Printing device in accordance with claim 6 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

9. Printing device in accordance with claim 1 characterized by that on the pivoting frame near the abutment, a gear segment curved around the pivoting axis is located, which engages with a gear shaft driven by a stepping motor and carried on the chassis.

10. Printing device in accordance with claim 9 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

11. Printing device in accordance with claim 1 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

12. Printing device in accordance with claim 3 characterized by that on the pivoting frame near the abutment, a gear segment curved around the pivoting axis is located, which engages with a gear shaft driven by a stepping motor and carried on the chassis.

13. Printing device in accordance with claim 3 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

14. Printing device in accordance with claim 4 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

15. Printing device in accordance with claim 7 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

16. Printing device in accordance with claim 12 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

17. Printing device in accordance with claim 2 characterized by that the printing head is carried on a carrier which in turn is adjustably guided on the pivoting frame for a movement parallel to the abutment, and further comprising an electric motor for driving the carrier, which motor is located on a distant side of the abutment of the pivoting axis on the pivoting frame.

18. Printing device in accordance with claim 1 characterized by that the printing head is carried on a carrier which in turn is adjustably guided on the pivoting frame for a movement parallel to the abutment, and further comprising an electric motor for driving the carrier, which motor is located on a distant side of the abutment of the pivoting axis on the pivoting frame.

19. Printing device in accordance with claim 18 characterized by that on the pivoting frame near the abutment, a gear segment curved around the pivoting axis is located, which engages with a gear shaft driven by a stepping motor and carried on the chassis.

20. Printing device in accordance with claim 18 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

21. Printing device in accordance with claim 17 characterized by that on the pivoting frame near the abutment, a gear segment curved around the pivoting axis is located, which engages with a gear shaft driven by a stepping motor and carried on the chassis.

22. Printing device in accordance with claim 17 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

23. Printing device in accordance with claim 19 characterized by that the printing device is adapted for use with a printing surface, and the printing head is carried on a rocker arm which is mounted on the pivoting frame in a pivoting mode around a second axis which is perpendicular to the pivoting axis and as a whole is parallel to the printing surface, and that the abutment is bent in circular arch form around the second axis.

24. Printing device in accordance with claim 21 characterized by that the printing device is adapted for use with a printing surface, and the printing head is carried on a rocker arm which is mounted on the pivoting frame in a pivoting mode around a second axis which is perpendicular to the pivoting axis as a whole is parallel to the printing surface, and that the abutment is bent in circular arch form around the second axis.

* * * * *